US011401636B2

(12) United States Patent
Amis et al.

(10) Patent No.: US 11,401,636 B2
(45) Date of Patent: Aug. 2, 2022

(54) SOCK WITH TAB

(71) Applicant: NIKE, Inc., Beaverton, OR (US)

(72) Inventors: Hannah R. Amis, Portland, OR (US); Ronen Yehuda, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 208 days.

(21) Appl. No.: 16/704,490

(22) Filed: Dec. 5, 2019

(65) Prior Publication Data

US 2020/0205481 A1 Jul. 2, 2020

Related U.S. Application Data

(60) Provisional application No. 62/785,896, filed on Dec. 28, 2018.

(51) Int. Cl.

| | |
|---|---|
| ***D04B 1/26*** | (2006.01) |
| ***A41B 11/00*** | (2006.01) |
| ***A41B 11/12*** | (2006.01) |
| ***D04B 1/10*** | (2006.01) |
| ***D04B 1/18*** | (2006.01) |

(Continued)

(52) U.S. Cl.

CPC ..... *D04B 1/26* (2013.01); *A41B 11/004* (2013.01); *A41B 11/12* (2013.01); *D04B 1/106* (2013.01); *D04B 1/18* (2013.01); *D04B 9/20* (2013.01); *D04B 9/56* (2013.01); *A41B 2400/44* (2013.01); *D10B 2403/0113* (2013.01)

(58) Field of Classification Search

CPC . D04B 1/106; D04B 1/18; D04B 1/26; D04B 9/20; D04B 9/56; D04B 1/24; A41B 11/12; A41B 11/02; A41B 11/04; A41B 2400/44

See application file for complete search history.

(56) References Cited

U.S. PATENT DOCUMENTS 767,381 A * 8/1904 Brown ..... A41B 11/00 2/239
1,806,492 A * 5/1931 Nestler ..... D04B 9/54 66/173

(Continued)

FOREIGN PATENT DOCUMENTS

FR 2879405 B1 4/2007
GB 2271923 A 4/1994

(Continued)

OTHER PUBLICATIONS

International Preliminary Report on Patentability received for PCT Patent Application No. PCT/US2019/065487, dated Jul. 8, 2021, 9 pages.

(Continued)

*Primary Examiner* — Danny Worrell
(74) *Attorney, Agent, or Firm* — Shook, Hardy & Bacon L.L.P.

(57) ABSTRACT

Aspects herein are directed to a sock having an integrally knit, two-layered tab positioned interior to a collar of the sock, where the collar defines an opening for a wearer's foot. By positioning the tab interior to the collar, the tab can be used to assist the wearer in donning and/or doffing the sock by acting as the primary structure by which the wearer pulls an elastic collar around the wearer's foot when donning the sock.

20 Claims, 5 Drawing Sheets

(51) Int. Cl.
*D04B 9/20* (2006.01)
*D04B 9/56* (2006.01)

(56) References Cited

U.S. PATENT DOCUMENTS

| | | | | | |
|---|---|---|---|---|---|
| 2,623,374 | A | * | 12/1952 | Hinchman | D04B 1/26 66/182 |
| 2,926,512 | A | | 3/1960 | Robertson | |
| 3,130,566 | A | | 4/1964 | Chesebro | |
| 3,289,329 | A | | 12/1966 | Weiss | |
| 3,601,818 | A | | 8/1971 | Chesebro et al. | |
| 3,975,929 | A | * | 8/1976 | Fregeolle | D04B 1/18 602/63 |
| 4,005,494 | A | * | 2/1977 | Burn | D04B 1/26 2/239 |
| 4,038,699 | A | * | 8/1977 | Burn | A41B 11/006 2/239 |
| 4,055,858 | A | | 11/1977 | Traenkle | |
| 4,169,324 | A | | 10/1979 | Gibbs | |
| 4,513,589 | A | | 4/1985 | Kearns | |
| 5,325,545 | A | | 7/1994 | Hirano | |
| 5,428,975 | A | | 7/1995 | Lee, III et al. | |
| 5,579,541 | A | | 12/1996 | Christy et al. | |
| 5,740,558 | A | | 4/1998 | Messman | |
| 7,076,973 | B1 | | 7/2006 | Chesebro, Jr. et al. | |
| D548,951 | S | | 8/2007 | Paulin | |
| D606,729 | S | | 12/2009 | Venturelli | |
| D769,611 | S | | 10/2016 | Ramirez-Tellez Shah | |
| D778,041 | S | | 2/2017 | Patterson | |
| D791,451 | S | | 7/2017 | Vakili | |
| D801,039 | S | | 10/2017 | Stuart | |
| 10,385,486 | B2 | * | 8/2019 | Amis | D04B 1/26 |
| 2006/0169005 | A1 | | 8/2006 | Chesebro et al. | |
| 2011/0061149 | A1 | | 3/2011 | Polacco et al. | |
| 2012/0311768 | A1 | | 12/2012 | Ladyzhenskaya et al. | |
| 2014/0304895 | A1 | | 10/2014 | Stuart | |
| 2015/0208758 | A1 | | 7/2015 | Williams, Sr. | |

FOREIGN PATENT DOCUMENTS

| | | | |
|---|---|---|---|
| JP | 2014058762 | A | 9/2012 |
| JP | 2017066565 | A | 4/2017 |
| KR | 20130021537 | A | 3/2013 |

OTHER PUBLICATIONS

"Nike Men's Perfect Cushion Socks," Macy's, macys.com, accessed: May 2018. https://www.macys.com/shop/product/nike-mens-perfect-cushion-socks?ID=4746368. 5 pages.

"ECCO Tab Sport Socks—Pima Cotton, Below the Ankle (For Men)," Sierra Trading Post, sierratradingpost.com, Item #124PJ, accessed: May 2018. https://www.sierratradingpost.com/ecco-tab-sport-socks-pima-cotton-below-the-ankle-for-men~p~124pj/. 7 pages.

"Socks with loops," Active Hands®, activehands.com, accessed: May 2018. https://www.activehands.com/product/socks-with-loops/. 5 pages.

"Robot Socks," EZ Sox®, ezsox.com, accessed: May 2018. https://ezsox.com/collections/socks/products/robot-socks. 5 pages.

"Balega Hidden Comfort Socks BAL8025 White," Go Bros, gobros.com, Manufacturer ID: 8025, accessed: May 2018. https://www.gobros.com/balega-hidden-comfort-socks-white-bal8025.html.

"Yoga Socks, Hand Knit Yoga Socks, Dance Socks, Knitted Toeless Socks, Knitted Spats, Flip Flop Socks, Piyo Socks, Yoga Wear, Pedicure socks," Etsy, etsy.com, shop: Spillija, accessed: May 2018. https://www.etsy.com/listing/274727886/yoga-socks-hand-knit-yoga-socks-dance.

"Low Rise Half Toe Gripper Socks Toesox," Nordstrom, nordstrom.com, Item #951808, accessed: May 2018. https://shop.nordstrom.com/s/toesox-low-rise-half-toe-gripper-socks/3580208.

International Search Report and Written Opinion received for PCT Patent Application No. PCT/US2019/065487, dated Mar. 11, 2020, 14 pages.

* cited by examiner

SOCK WITH TAB

CROSS REFERENCE TO RELATED APPLICATIONS

This application, having Ser. No. 16/704,490 and entitled "Sock With Tab," claims priority to U.S. Provisional Application No. 62/785,896, filed Dec. 28, 2018, and entitled "Sock With Tab," the contents of which are hereby incorporated by reference herein.

TECHNICAL FIELD

Aspects herein related to a sock having an integrally knit tab for easier donning and doffing.

BACKGROUND

Traditional tabs used to assist wearers in donning and/or doffing socks are often added in a post-manufacturing step such as by stitching the tab to a collar of the formed sock. In instances where the tab is formed with the sock, the tab is often not positioned to effectively help the wearer in donning or doffing the sock or lacks the structural integrity to withstand repeated use.

DESCRIPTION OF THE DRAWINGS

Examples of aspects herein are described in detail below with reference to the attached drawing figures, wherein.

DETAILED DESCRIPTION

Figure 1:
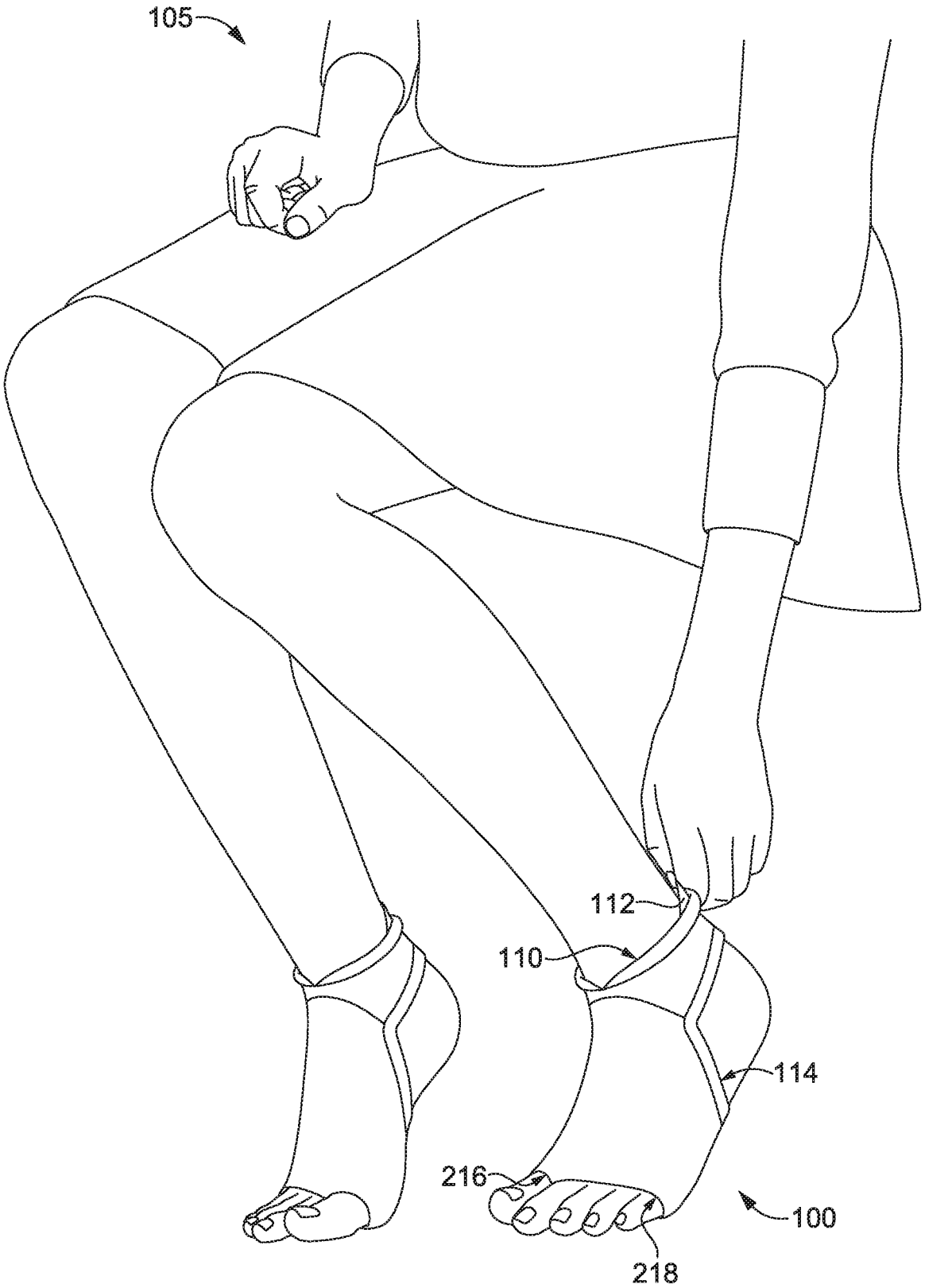
FIG. 1 illustrates a wearer donning a sock having an integrally knit tab in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed to a knit sock having a collar that forms a perimeter edge around a foot opening for receiving a wearer's foot. The sock additionally includes a knit tab that is integrally knit with the sock and that extends adjacent to an interior surface of the collar and through the foot opening. The sock may additionally comprise features such as a heel opening through which a portion of a wearer's heel extends when the sock is worn, as well as one or more toe openings through which a wearer's toes extend when the sock is worn. The sock thus described saves on manufacturing costs, time, and steps as the tab is integrally knit with the sock thereby decreasing post-knitting processing steps. As well, by positioning the tab interior to the collar, the tab can be used to assist the wearer in donning and/or doffing the sock by acting as the primary structure by which the wearer pulls the elastic collar around the wearer's foot when donning the sock and/or pulls the elastic collar off of the wearer's foot when doffing the sock thereby decreasing wear-and-tear on the collar. In addition, because the sock comprises a number of openings (e.g., foot opening, toe opening, and heel opening), the tab serves as a visual indicator as to where the wearer inserts her foot.

In aspects, the tab comprises a tab base, a tab body extending from the tab base, and a top edge spaced apart from the tab base by the tab body. In aspects, the tab base is integrally knit with a heel portion of the sock and is positioned at an inferior margin of the collar, and the top edge of the tab extends superior to at least a portion of the collar in the back of the sock to allow easy access to the tab. Moreover, in example aspects, the tab is knit to have a two-layer construction thereby adding bulk to the tab making it easier to manipulate and increasing its durability. Still further, the tab may be knit to include ribs to allow greater traction when a wearer exerts tension on the tab.

It is contemplated herein that the sock, including the tab, is knit on a circular knit machine. In example aspects, the tab may be knit through a reciprocating motion on the circular knit machine using a first set of needles, while remaining needles on the circular knit machine are inactive. For instance, and as will be discussed further below, a heel portion of the sock may be knit using all of the needles on the circular knit machine. Then the tab is knit with a narrowing reciprocated section and a widening reciprocated section using the first set of needles. In example aspects, the tab is knit using a 1×1 rib. In example aspects, the tab is knit such that every other needle of the first set of needles is knitting the tab and alternate needles in the first set of needles are holding the last course from the heel portion. When the tab is finished being knit, the alternate needles in the first set of needles that were holding the last course from the heel portion transfer their loops to the active needles in the first set of needles thereby closing the tab, securing the tab to the heel portion, and forming the two-layer construction.

Continuing, with respect to the two-layer construction of the tab, it is contemplated that a technical back of the first layer of the knit tab is external facing toward the collar, and the technical back of the second layer of the knit tab is external facing toward the foot opening. It is further contemplated herein that the technical face of each layer of the knit tab is internal facing. That is, the technical face of each of the first layer and the second layer of the tab faces inward toward each other in the interior of the tab. The two layers of the tab are integrally knit with each other along at least the top edge of the tab as well as side edges of the tab (i.e., the side edges extending from the tab base to the top edge of the tab).

Positional terms as used herein such as "medial," "lateral," "front," "back" "interior surface," "exterior surface," "external facing," "internal facing," "inferior," "upper," "lower," "superior," "top," and the like, are with a sock being worn as intended and as shown and described herein by a wearer standing in anatomical position. As such, the medial side of the sock is positioned adjacent to a medial portion of a wearer's foot when the sock is worn, and the lateral side of the sock is positioned adjacent to a lateral portion of the wearer's foot when the sock is worn. The top or dorsal portion of the sock is positioned adjacent to the dorsum of the wearer's foot when the sock is worn, and the bottom or plantar portion of the sock is positioned adjacent to the sole of the wearer's foot when the sock is worn. The internal-facing surface of the sock is positioned toward a skin surface of the wearer when the sock is worn, and the external-facing surface of the sock faces outward or away from the skin surface of the wearer when the sock is worn.

The term "knitted course" as described herein is a predominantly horizontal row of knitted loops (in an upright fabric as knit) produced by adjacent needles during the same knitting cycle. The knitted course may comprise one or more stitch types such as a loop stitch, a held stitch, a float stitch, a tuck stitch, a transfer stitch, and the like as these terms are known in the art of knitting. The term "technical back" as used herein refers to the inner side or underside of the fabric or textile as it is being knit. The term "technical back" may also be defined as the side of the fabric or textile that contains back loops or purl loops. And the term "technical face" as used herein refers to the outer or upper side of the fabric or textile as it is being knit. The term "technical face" may also be defined as the side of the fabric or textile that contains face loops or weft knit loops. The term "integrally knit" as used herein may mean a textile or fabric having a yarn from one or more knitted courses being interlooped with one or more knitted courses of another area. For instance, a tab may be integrally knit with a heel portion of a sock if a yarn from one or more knitted courses of the tab is interlooped with one or more knitted courses in the heel portion. The term "elastomeric" as used herein when describing yarns generally means a yarn type that may provide a maximum stretch greater than about 200% under load prior to returning to its non-stretched state when the load is removed, and some elastomeric yarns provide a maximum stretch of about 400%. Examples of elastomeric yarn types include, LYCRA®, elastane, spandex, rubber, and the like. The term "about" used when, for instance, describing numerical ranges means within ±10% of a designated value unless indicated otherwise. Unless indicated otherwise, all measurements provided herein are taken when the sock is at standard ambient temperature and pressure (298.15 K and 100 kPa) and the sock is in a resting state (e.g., an unstretched state).

Turning now to FIG. 1, a wearer 105 is shown donning a sock 100 having a collar 110 defining a foot opening, and an integrally knit tab 112 positioned interior to the collar 110 in accordance with aspects herein. The sock 100 is shown in the form of a liner sock or a ped sock although other sock lengths are contemplated herein such as a no-show sock, a quarter sock, a crew sock, or an over-the-calf or executive sock. To don the sock 100, once the wearer 105 inserts her foot into the foot opening, the wearer 105 exerts an upward tension on the tab 112 with her fingers which acts to pull the collar 110 around the wearer's foot. This action is facilitated by having the top edge of the tab 112 positioned superior to the top edge of the collar 110 at least with respect to the back aspect of the sock 100 thereby allowing the wearer 105 to easily grasp the tab 112. To doff the sock 100, the wearer 105 would exert a downward tension on the tab 112 which acts to pull the collar 110 down and off the wearer's foot.

With further respect to FIG. 1, additional optional features of the sock 100 are depicted including a heel opening 114 through which at least a portion of the wearer's heel extends, and one or more toe openings including a first toe opening 216 and a second toe opening 218 through which the wearer's toes extend. In example aspects, the sock 100 may be suitable for activities such as yoga, bane classes, Pilates, and the like which require the wearer's feet and toes to be able to grab a floor or exercise surface. Because of the number of openings, it may be difficult to orient the sock 100 such that the wearer 105 inserts her foot in the correct opening. To facilitate orientation, the wearer 105 may use the tab 112 as a visual indicator of the correct opening through which the wearer's foot is inserted.

Figure 2:
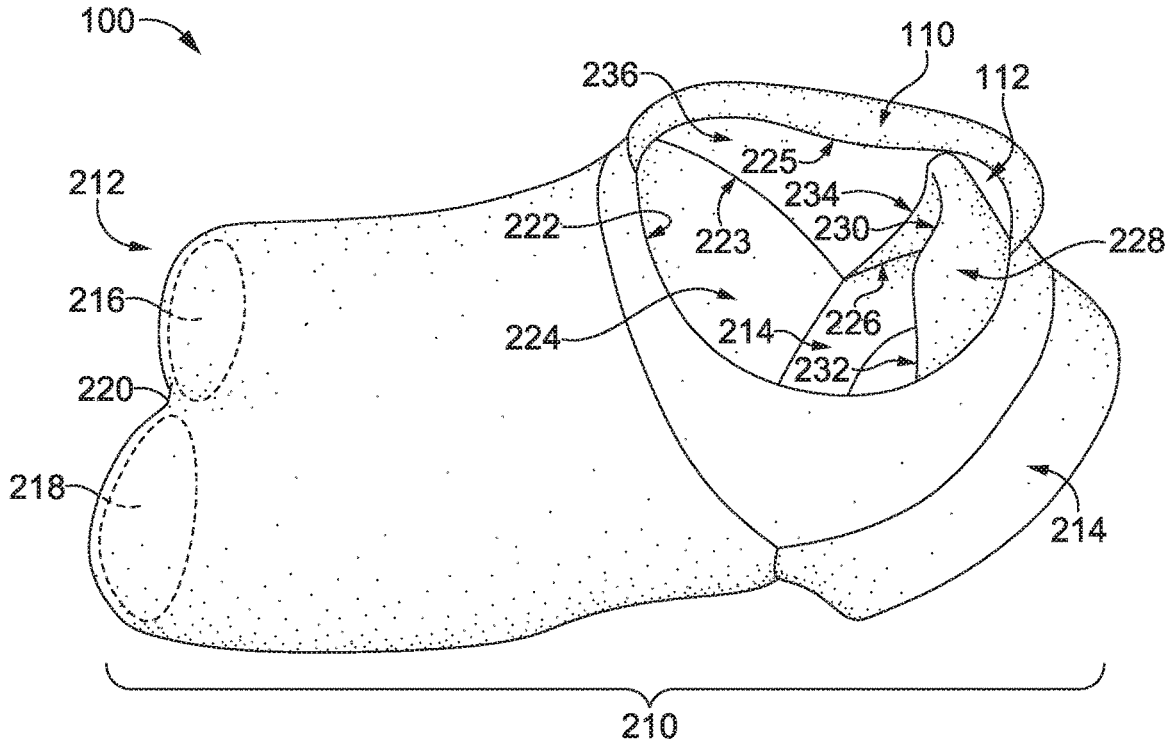
FIG. 2 illustrates a top, perspective view of a sock with an integrally knit tab in accordance with aspects herein.

FIG. 2 illustrates a top perspective view of the sock 100 in accordance with aspects herein. In some example aspects, the sock 100 is foot-agnostic, but it is also contemplated herein that the sock 100 could have features, such as a toe anchor 220, adapting the sock 100 to a left foot or a right of a wearer. With respect to the sock 100 shown in FIG. 2, it is contemplated herein that the sock 100 is configured to be worn on a left foot of a wearer. The sock 100 comprises a sock body 210 having a toe area 212 and a heel portion 214 where the heel portion 214 may define or form a perimeter edge around the optional heel opening 114 (better shown in FIG. 3) through which at least a portion of a wearer's heel may extend. In an optional aspect, the toe area 212 may comprise the first toe opening 216 and the second toe opening 218 (shown in dashed lines to indicate the first and second toe openings 216 and 218 may not be visible due to the perspective view of FIG. 2), where the first toe opening 216 and the second toe opening 218 are separated by the toe anchor 220. The first toe opening 216 may be configured to receive a wearer's big toe (i.e., the wearer's first hallux), and the second toe opening 218 may be configured to receive the wearer's remaining toes. As such, the first toe opening 216 may have a smaller circumference and/or diameter than the second toe opening 218.

Figure 3:
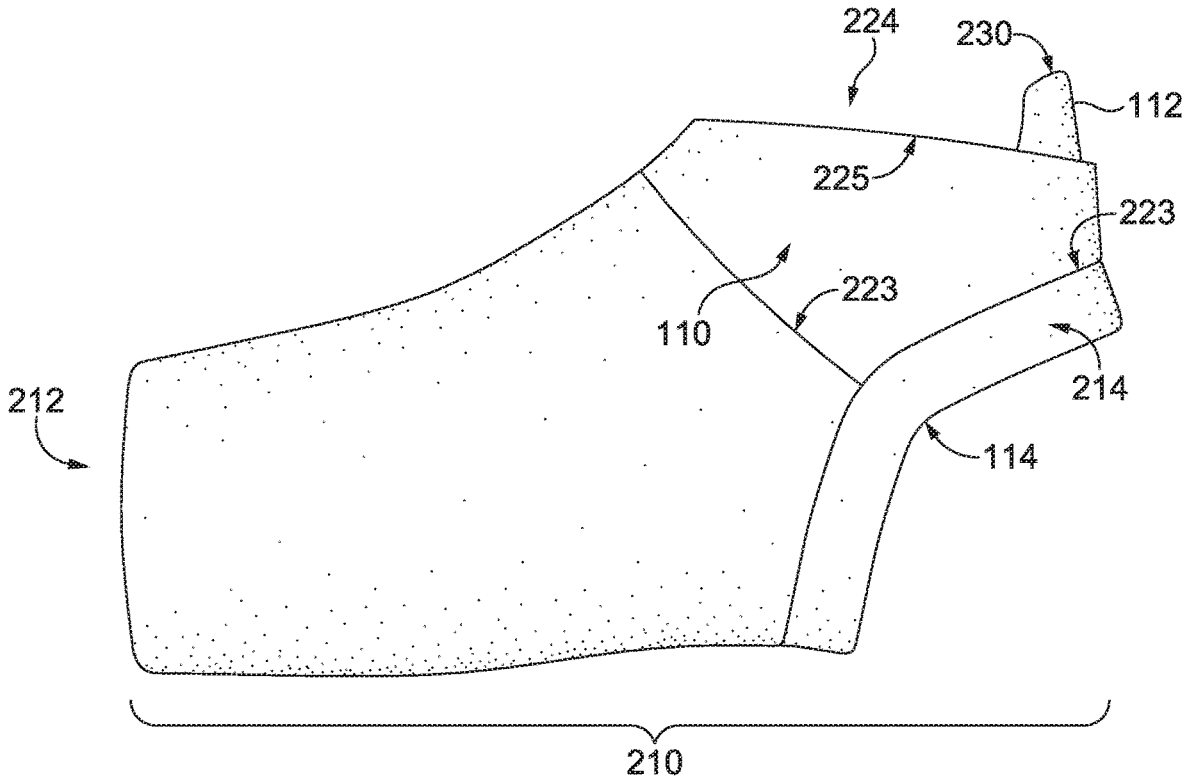
FIG. 3 illustrates a side view of the sock of FIG. 2 in accordance with aspects herein.

Continuing, the sock 100 comprises the collar 110 that forms or defines a perimeter edge 222 around a foot opening 224 for receiving a wearer's foot. In example aspects, the collar 110 comprises a plurality of knit courses such that the collar 110 comprises an inferior margin 223 and a superior margin 225. In example aspects, and as shown in FIG. 2, the superior margin 225 of the collar 110 may roll inward in some aspects. It is also contemplated that the collar 110 may roll outward. FIG. 3 depicts the collar 110 in an unrolled state. As shown in both FIGS. 2 and 3, the collar 110 extends superiorly a predetermined distance from its inferior margin 223 to its superior margin 225 when the sock 100 is in an as-worn configuration. In example aspects, the collar 110 and/or other portions of the sock body 210 may be knit with an elastomeric yarn to impart a first modulus of elasticity to the collar 110. In example aspects, the collar 110 may be knit with a DX156 SC 2/68 yarn.

The sock 100 also comprises the tab 112 positioned at a back aspect of the sock 100. The tab 112 comprises at least a tab base 226, a tab body 228 extending from the tab base 226, and a top edge 230 spaced apart from the tab base 226 by the tab body 228. The tab 112 further comprises a first side edge 232 extending from the tab base 226 to the top edge 230, and a second side edge 234 opposite the first side edge 232 and also extending from the tab base 226 to the top edge 230. In example aspects, the tab base 226 is integrally knit with the heel portion 214 and is positioned at the inferior margin 223 of the collar 110.

As shown in FIG. 2, the tab 112 is positioned interior to the collar 110. That is, the tab 112 extends adjacent to an interior surface 236 of the collar 110, through the foot opening 224, and to its top edge 230. In example aspects, at least a portion of the tab body 228 and the top edge 230 of the tab 112 are unaffixed from, detached from, or separate from the collar 110. In other example aspects, at least the top edge 230 of the tab 112 is unaffixed from or detached from the collar 110. Positioning the tab 112 interior to the collar 110 enables the tab 112 to be in contact with the back of a wearer's foot and to act as the primary structure by which the collar 110 can be drawn around a wearer's foot and/or the collar 110 to be removed from the wearer's foot. Moreover, by positioning the tab 112 interior to the collar 110, the collar 110 is prevented from folding over or being trapped between the tab 112 and the wearer's foot when donning the sock 100 as may occur if the tab 112 were positioned external to the collar 110. As shown in FIG. 2, the tab 112 tapers in a widthwise direction as the tab 112 extends from the tab base 226 to the top edge 230 of the tab 112.

With further reference to FIG. 3, a side view of the sock 100 is depicted in accordance with aspects herein. The side view in FIG. 3 depicts more clearly the optional heel opening 114 formed by the heel portion 214 of the sock body 210. The top edge 230 of the tab 112 is shown extending past the superior margin 225 of the collar 110 at least at the back aspect of the sock 100. This aspect occurs regardless of whether the superior margin 225 of the collar is in a rolled state (shown in FIG. 2) or an unrolled state (shown in FIG. 3). To state this differently, at least a portion of the superior margin 225 of the collar 110 is positioned between the top edge 230 of the tab 112 and the tab base 226 (not visible in FIG. 3). By having the top edge 230 of the tab 112 extend past the superior margin 225 of the collar 110 at the back aspect of the sock 100, a wearer may more easily grasp the tab 112 when donning and doffing the sock 100.

Continuing, it is contemplated herein that the tab 112 may be knit with an elastomeric yarn such as, for example, a 200 Dtex SC 40/48 yarn type to impart a second modulus of elasticity to the tab 112. In example aspects, the first modulus of elasticity of the collar 110 is less than the second modulus of elasticity of the tab 112. In functional terms, forming the collar 110 to have a greater stretch characteristic than, for instance, the tab 112, enables the collar 110 to more easily stretch when donning the sock 100 and to more easily accommodate different ankle circumferences while maintaining wearer comfort. And by forming the tab 112 to be "stiffer" or to have a lesser stretch characteristic provides a more sturdy (i.e., less stretchy) structure for grabbing by the wearer when donning or doffing the sock 100.

Figure 4:
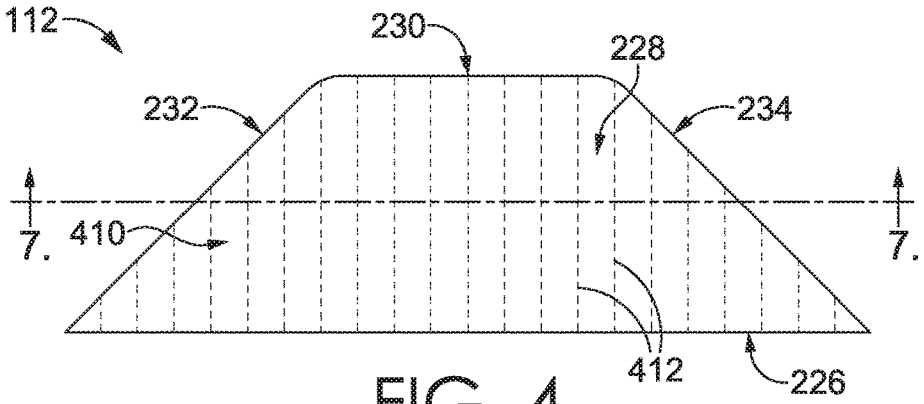
FIG. 4 illustrates an isolated view of the tab of the sock of FIG. 2 depicting the surface of the tab facing the collar of the sock in accordance with aspects herein.
Figure 5:
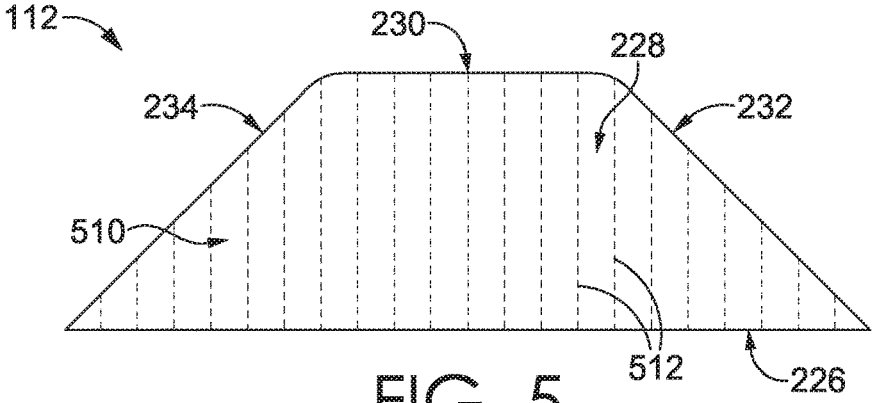
FIG. 5 illustrates an isolated view of the tab of the sock of FIG. 2 depicting the surface of the tab facing the foot opening of the sock in accordance with aspects herein.

FIGS. 4 and 5 illustrate isolated views of the tab 112 in accordance with aspects herein. The tab 112 comprises the tab base 226, the tab body 228 extending from the tab base 226, and the top edge 230 spaced apart from the tab base 226 by the tab body 228. The tab 112 further comprises the first side edge 232 and the second side edge 234, where each of the first side edge 232 and the second side edge 234 extend from the tab base 226 to the top edge 230. As shown in FIGS. 4 and 5, the tab 112 tapers in a widthwise direction from the tab base 226 to the top edge 230.

More specifically with respect to FIGS. 4 and 5, FIG. 4 depicts a first exterior surface 410 of the tab 112 that faces the interior surface 236 of the collar 110 of the sock 100, and FIG. 5 depicts a second opposite exterior surface 510 of the tab 112 that faces toward the foot opening 224 of the sock 100. In example aspects, each of the first exterior surface 410 and the second exterior surface 510 is knit to have a plurality of vertically oriented ribs 412 and 512 respectively. To describe this differently, each of the ribs 412 and 512 extends in a vertical direction between the tab base 226 and the top edge 230. Having ribs may provide better traction as a wearer exerts tension on the tab 112 to don or doff the sock 100. Although shown as having vertical ribs, it is contemplated herein that the ribs may have other orientations such as horizontal. As will be explained further below, the tab 112 is knit to have a two-layer construction. In example aspects, each of the first exterior surface 410 and the second exterior surface 510 of the tab 112 comprises a technical back of the respective layers.

Figure 6:
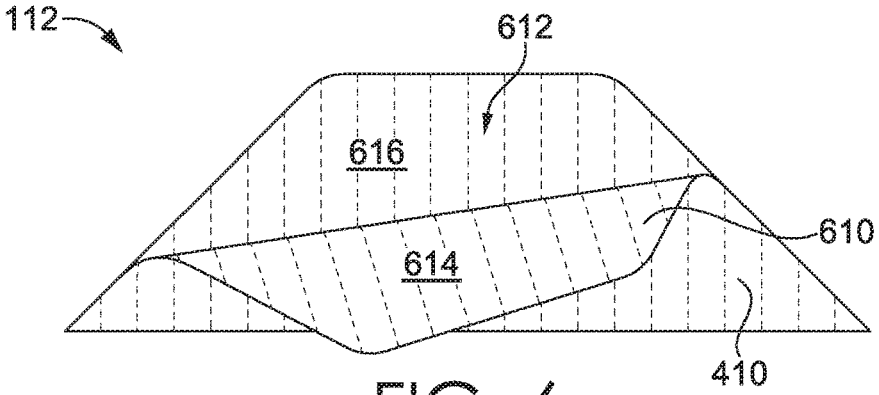
FIG. 6 illustrates the isolated view shown in FIG. 4 with a layer of the tab folded back to depict the interior of the tab in accordance with aspects herein.
Figure 7:
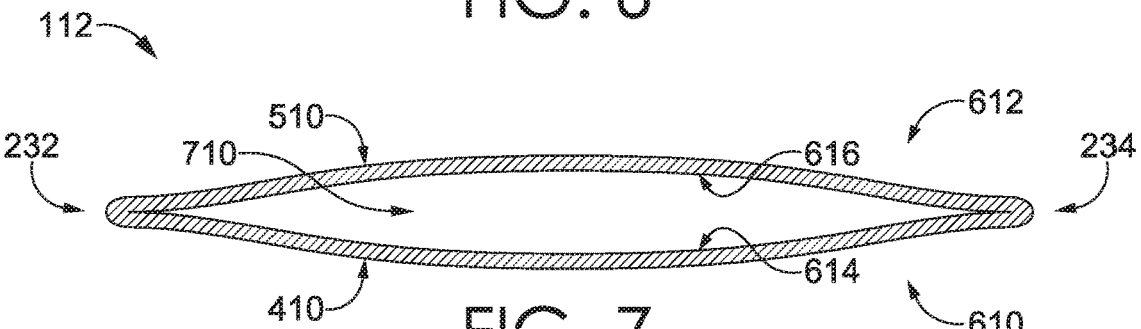
FIG. 7 illustrates a cross-section view of the tab taken along cut line 7-7 of FIG. 4 in accordance with aspects herein.

FIGS. 6 and 7 more clearly depict the two-layer construction of the tab 112. FIG. 6 is a view of the first exterior surface 410 of the tab 112 with a portion of a first layer 610 of the tab 112 folded back to expose a first interior surface 614 of the first layer 610. FIG. 6 further depicts a second interior surface 616 of a second layer 612 of the tab 112. In example aspects, each of the first interior surface 614 and the second interior surface 616 comprises a technical face of the respective first and second layers 610 and 612. To describe this a different way, the first interior surface 614 of the first layer 610 faces toward the second interior surface 616 of the second layer 612 in the interior of the tab 112. To describe this in yet a different way, the technical face of the first layer 610 faces toward the technical face of the second layer 612 in the interior of the tab 112.

FIG. 7 illustrates a cross-sectional view of the tab 112 taken along cut line 7-7 of FIG. 4. FIG. 7 illustrates the first layer 610 of the tab 112 having the first exterior surface 410 and the first interior surface 614, and the second layer 612 of the tab 112 having the second exterior surface 510 and the second interior surface 616. FIG. 7 further depicts a space 710 formed between the first interior surface 614 and the second interior surface 616 in the interior of the tab 112. It is contemplated herein, that the first layer 610 and the second layer 612 are integrally knit with each other at the first side edge 232 and the second side edge 234 of the tab 112. Although not shown, it is also contemplated herein that the first layer 610 and the second layer 612 of the tab 112 are integrally knit with each other at the top edge 230 of the tab 112.

Figure 8:
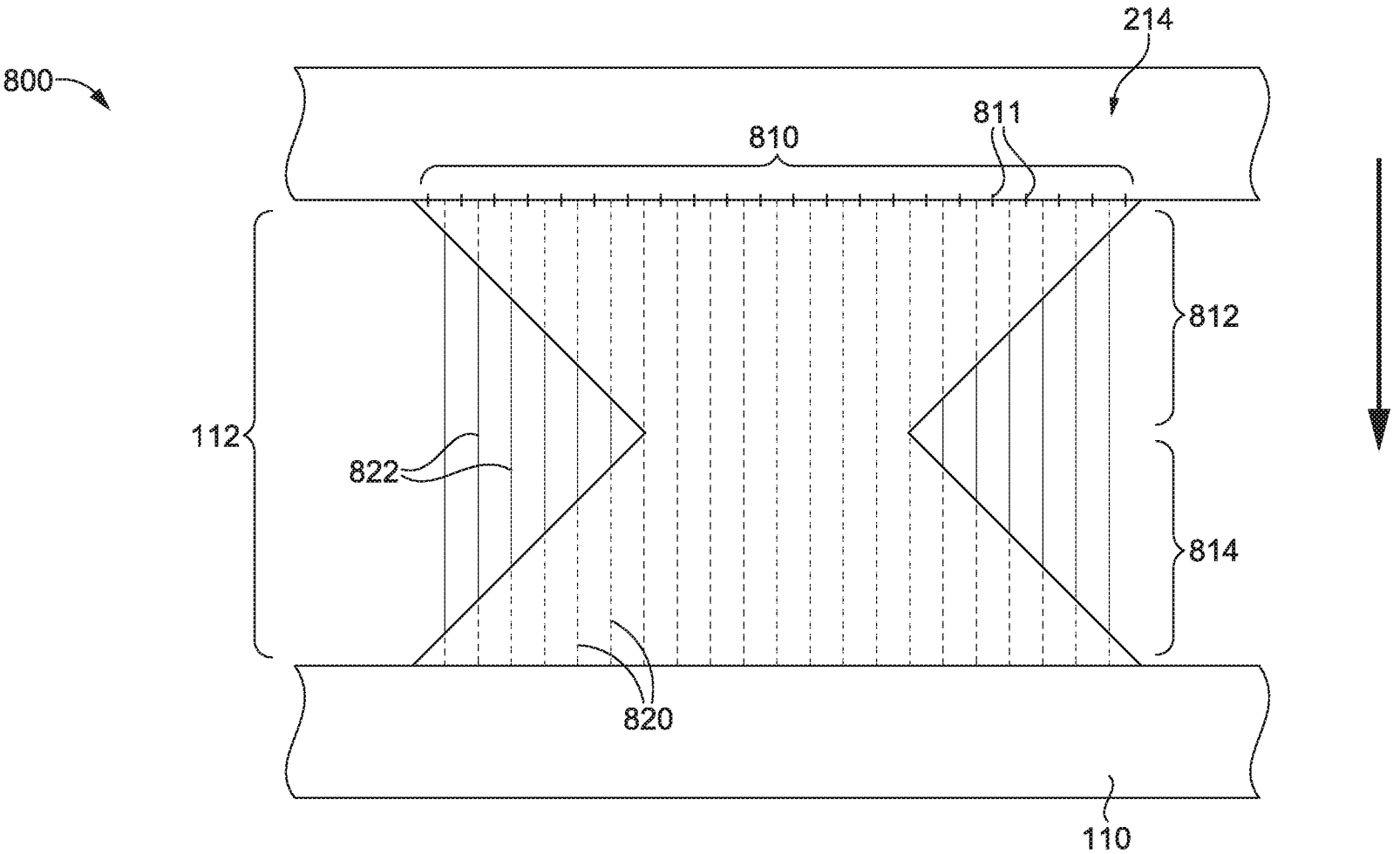
FIG. 8 illustrates a diagrammatic representation of knitting a tab in accordance with aspects herein.

Turning now to FIG. 8, an example aspect of knitting the tab 112 on a circular knit machine is shown in a schematic fashion. An example circular knit machine comprises a 160 needle, 3.75 inch circular knit machine. With reference to FIG. 8, a segment of the heel portion 214 is shown that is knit on the circular knit machine. In example aspects, the heel portion 214 is the first portion of the sock 100 to be knit and is knit in a circular fashion using all of the needles on the circular knit machine. The tab 112 is then integrally knit with the segment of the heel portion 214 such that the tab 112 will be positioned at the back of the sock 100 when the knitting process is completed. In example aspects, the tab 112 is knit using a first set of needles 810 that act in a reciprocating motion, where the first set of needles 810 comprises a subset of the needles on the circular knit machine.

Continuing, in example aspects the tab 112 is knit using a 1×1 rib (the ribs are shown in dashed lines and are indicated by reference numeral 820) such that every other needle of the first set of needles 810 is knitting the tab and alternate needles (indicated by reference numeral 811) in the first set of needles 810 are inactive and hold the last course of loops from the heel portion 214. The active needles in the first set of needles 810 knit the tab with a narrowing reciprocated section 812 followed by a widening reciprocated section 814 using a loop transfer process where reference numeral 822 indicates the yarns that are transferred between the narrowing reciprocated section 812 and the widening reciprocated section 814. Although the transfer yarns 822 are shown having a length for illustrative purposes, in reality they comprise a single stitch such that the tab 112 is folded onto itself as the widening reciprocated section 814 is knit.

Continuing still, after the widening reciprocated section 814 is knit, the inactive, alternate needles 811 in the first set of needles 810 transfer their loops to the active needles in the first set of needles 810 thereby closing the tab 112 at the tab base 226 and securing the tab base 226 to the heel portion 214. In example aspects, after the tab 112 is knit, the collar 110 may be knit. More specifically, a first side half of the collar 110 may be knit using a set of needles on the circular knit machine that act in a reciprocating fashion. A second side half of the collar 110 may then be knit using a set of needles on the circular knit machine that act in a reciprocating fashion. In aspects, the first side half of the collar 110 and the second side half of the collar 110 may each be knit to form a triangle-shaped panel as shown in, for instance, FIG. 3. After the second side half of the collar 110 is knit, all of the needles on the circular knit machine may be used to knit the sock body 210 in a circular manner.

Figure 9:
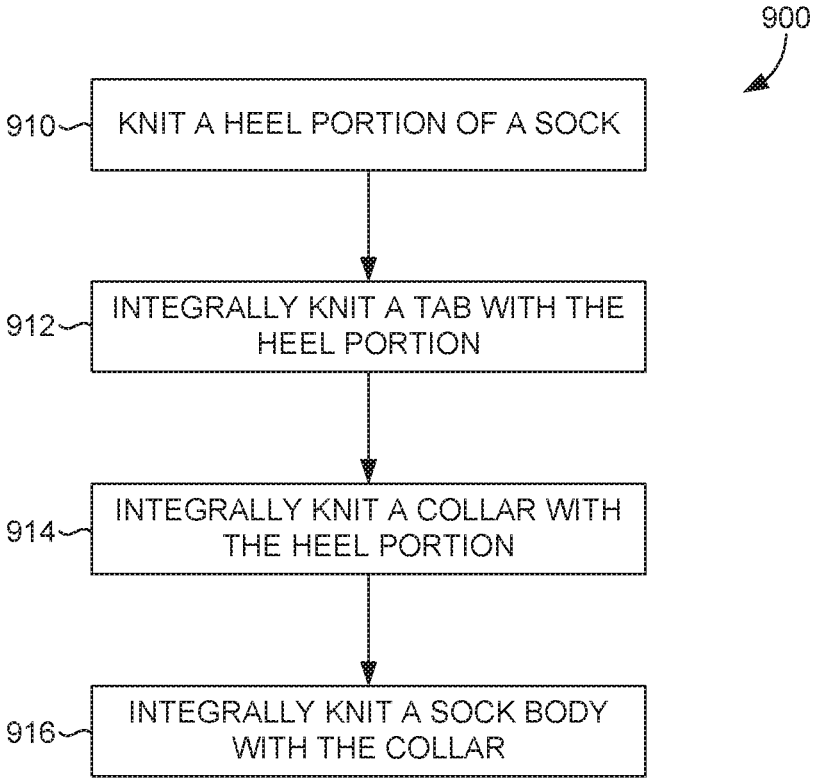
FIG. 9 illustrates a flow diagram of an example method of knitting a sock having an integrally knitted tab in accordance with aspects herein.

FIG. 9 is a flow diagram of an example method 900 of knitting a sock such as the sock 100 in accordance with aspects herein. At a step 910 a heel portion, such as the heel portion 214, is knit on a circular knit machine using all of the needles on the circular knit machine, where the needles knit in a circular manner. In example aspects, the heel portion may be knit as a welt. At a step 912, a tab, such as the tab 112 is integrally knit with a segment of the heel portion. In aspects, the tab is knit as discussed above with respect to FIG. 8 and is positioned so that it is located at a back aspect of the sock. At a step 914, a collar, such as the collar 110, is integrally knit with the heel portion. After the collar is knitted, the tab is positioned interior to the collar. And at a step 916, a sock body is integrally knit with the collar and with the heel portion of the sock.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A sock comprising:

a sock body;

a collar integrally knit with the sock body, the collar having an interior surface and an exterior surface, the collar comprising a perimeter edge around an opening for receiving a wearer's foot; and a tab having a tab base, a tab body extending from the tab base, and a top edge spaced apart from the tab base by the tab body, wherein the tab base is integrally knit with the sock body, and wherein the tab extends adjacent to the interior surface of the collar and through the opening.

Clause 2. The sock according to clause 1, wherein at least a portion of a superior margin of the collar is positioned between the top edge of the tab and the tab base.

Clause 3. The sock according to any of clauses 1 through 2, wherein the tab comprises a two-layer construction such that a technical back of the tab is external facing toward the collar and toward the opening, and a technical face of the tab is internal facing.

Clause 4. The sock according to clause 3, wherein the two-layer construction comprises a first layer and a second layer, each of the first layer and the second layer comprising corresponding edges along a first side edge of the tab and along a second side edge of the tab.

Clause 5. The sock according to any of clauses 1 through 4, wherein the top edge of the tab is separate from the collar.

Clause 6. The sock according to any of clauses 1 through 5, wherein the tab tapers in a widthwise direction as it extends from the tab base to the top edge of the tab.

Clause 7. The sock according to any of clauses 1 through 6, wherein the collar comprises an elastomeric yarn such that the collar has a smaller modulus of elasticity than the tab.

Clause 8. A sock comprising:

a sock body;

a collar integrally knit with the sock body, the collar having an interior surface and an exterior surface, the collar comprising a perimeter edge around an opening for receiving a wearer's foot; and a tab comprising:

a tab base, a tab body extending from the tab base, and a top edge spaced apart from the tab base by the tab body, the tab base coupled to the sock body, wherein the tab is an integrally knit two-layer knit construction such that a technical back of the tab is external facing toward the interior surface of the collar and toward the opening, and a technical face of the tab is internal facing.

Clause 9. The sock according to clause 8, wherein the two-layer knit construction comprises a first layer and a second layer, each of the first layer and the second layer comprising corresponding edges along a first side edge of the tab and along a second side edge of the tab.

Clause 10. The sock according to clause 9, wherein the corresponding edges along the first side edge of the tab are integrally knit with each other and the corresponding edges along the second side edge of the tab are integrally knit with each other.

Clause 11. The sock according to any of clauses 8 through 10, wherein the tab tapers in a widthwise direction as it extends from the tab base toward the top edge.

Clause 12. The sock according to any of clauses 8 through 11, wherein the tab base is integrally knitted with the sock body.

Clause 13. The sock according to any of clauses 8 through 12, wherein at least a portion of a superior margin of the collar is positioned between the top edge of the tab and the tab base.

Clause 14. A method of knitting a sock using a circular knit machine, the method comprising:

knitting a heel portion of the sock;

integrally knitting a tab with the heel portion of the sock, the tab comprising a tab base, a tab body extending from the tab base, and a top edge spaced apart from the tab base by the tab body;

integrally knitting a collar with the heel portion of the sock, the collar having an interior surface and an exterior surface, the collar having a perimeter edge around an opening for receiving a wearer's foot, wherein the tab extends adjacent to the interior surface of the collar and through the opening; and integrally knitting a sock body with the collar.

Clause 15. The method of knitting the sock using the circular knit machine according to clause 14, wherein at least a portion of a superior margin of the collar is positioned between the top edge of the tab and the tab base.

Clause 16. The method of knitting the sock using the circular knit machine according to any of clauses 14 through 15, wherein the top edge of the tab is separate from the collar.

Clause 17. The method of knitting the sock using the circular knit machine according to any of clauses 14 through 16, wherein the tab is reciprocally knitted using a first set of needles of the circular knit machine.

Clause 18. The method of knitting the sock using the circular knit machine according to any of clauses 14 through 17, wherein the tab is a two-layer knit construction having a first layer and a second layer, each of the first layer and the second layer having corresponding edges along a first side of the tab and corresponding edges along a second side of the tab.

Clause 19. The method of knitting the sock using the circular knit machine according to clause 18, wherein the corresponding edges along the first side of the tab are integrally knit with each other and the corresponding edges along the second side of the tab are integrally knit with each other.

Clause 20. The method of knitting the sock using the circular knit machine according to any of clauses 14 through 19, wherein the collar is knitted using an elastomeric yarn such that the collar has a smaller modulus of elasticity than the tab.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A sock comprising:

a sock body;

a collar integrally knit with the sock body, the collar having an interior surface and an exterior surface, the collar comprising a perimeter edge around an opening for receiving a wearer's foot; and a tab having a tab base positioned at an inferior margin of the collar, a tab body extending from the tab base, and a top edge extending above a superior margin of the collar and spaced apart from the tab base by the tab body, wherein the tab base is integrally knit with the sock body, and wherein the tab extends adjacent to the interior surface of the collar and through the opening.

2. The sock of claim 1, wherein at least a portion of a superior margin of the collar is positioned between the top edge of the tab and the tab base.

3. The sock of claim 1, wherein the tab comprises a two-layer construction such that a technical back of the tab is external facing toward the collar and toward the opening, and a technical face of the tab is internal facing.

4. The sock of claim 3, wherein the two-layer construction comprises a first layer and a second layer, each of the first layer and the second layer comprising corresponding edges along a first side edge of the tab and along a second side edge of the tab.

5. The sock of claim 1, wherein the top edge of the tab is separate from the collar.

6. The sock of claim 5, wherein the tab tapers in a widthwise direction as it extends from the tab base to the top edge of the tab.

7. The sock of claim 1, wherein the collar comprises an elastomeric yarn such that the collar has a smaller modulus of elasticity than the tab.

8. A sock comprising:

a sock body;

a collar integrally knit with the sock body, the collar having an interior surface and an exterior surface, the collar comprising a perimeter edge around an opening for receiving a wearer's foot; and a tab comprising:

a tab base positioned at an inferior margin of the collar, a tab body extending from the tab base, and a top edge extending above a superior margin of the collar and spaced apart from the tab base by the tab body, the tab base coupled to the sock body, wherein the tab is an integrally knit two-layer knit construction such that a technical back of the tab is external facing toward the interior surface of the collar and toward the opening, and a technical face of the tab is internal facing.

9. The sock of claim 8, wherein the two-layer knit construction comprises a first layer and a second layer, each of the first layer and the second layer comprising corresponding edges along a first side edge of the tab and along a second side edge of the tab.

10. The sock of claim 9, wherein the corresponding edges along the first side edge of the tab are integrally knit with each other and the corresponding edges along the second side edge of the tab are integrally knit with each other.

11. The sock of claim 8, wherein the tab tapers in a widthwise direction as it extends from the tab base toward the top edge.

12. The sock of claim 8, wherein the tab base is integrally knitted with the sock body.

13. The sock of claim 8, wherein at least a portion of a superior margin of the collar is positioned between the top edge of the tab and the tab base.

14. A method of knitting a sock using a circular knit machine, the method comprising:

knitting a heel portion of the sock;

integrally knitting a collar with the heel portion of the sock, the collar having an interior surface, an exterior surface, and a perimeter edge around an opening for receiving a wearer's foot;

integrally knitting a tab with the heel portion of the sock, the tab comprising a tab base positioned at an inferior margin of the collar, a tab body extending from the tab base, and a top edge extending above a superior margin of the collar and spaced apart from the tab base by the tab body, wherein the tab extends adjacent to the interior surface of the collar and through the opening; and integrally knitting a sock body with the collar.

15. The method of knitting the sock using the circular knit machine of claim 14, wherein at least a portion of a superior margin of the collar is positioned between the top edge of the tab and the tab base.

16. The method of knitting the sock using the circular knit machine of claim 14, wherein the top edge of the tab is separate from the collar.

17. The method of knitting the sock using the circular knit machine of claim 14, wherein the tab is reciprocally knitted using a first set of needles of the circular knit machine.

18. The method of knitting the sock using the circular knit machine of claim 14, wherein the tab is a two-layer knit construction having a first layer and a second layer, each of the first layer and the second layer having corresponding edges along a first side of the tab and corresponding edges along a second side of the tab.

19. The method of knitting the sock using the circular knit machine of claim 18, wherein the corresponding edges along the first side of the tab are integrally knit with each other and the corresponding edges along the second side of the tab are integrally knit with each other.

20. The method of knitting the sock using the circular knit machine of claim 14, wherein the collar is knitted using an elastomeric yarn such that the collar has a smaller modulus of elasticity than the tab.

* * * * *